US010494210B2

(12) United States Patent
Kamikawa et al.

(10) Patent No.: US 10,494,210 B2
(45) Date of Patent: Dec. 3, 2019

(54) IMAGE FORMING APPARATUS

(71) Applicant: Brother Kogyo Kabushiki Kaisha, Nagoya (JP)

(72) Inventors: Kazuya Kamikawa, Nagakute (JP); Shoichiro Nishimura, Ama-gun (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 131 days.

(21) Appl. No.: 15/878,654

(22) Filed: Jan. 24, 2018

(65) Prior Publication Data

US 2018/0282088 A1 Oct. 4, 2018

(30) Foreign Application Priority Data

Mar. 31, 2017 (JP) ..... 2017-073304

(51) Int. Cl.
*G03G 15/00* (2006.01)
*G03G 15/23* (2006.01)
(Continued)

(52) U.S. Cl.
CPC ..... *B65H 5/062* (2013.01); *B65H 1/04* (2013.01); *B65H 1/266* (2013.01); *B65H 3/06* (2013.01); *B65H 5/38* (2013.01); *B65H 85/00* (2013.01); *G03G 15/234* (2013.01); *G03G 15/6508* (2013.01); *G03G 21/1695* (2013.01);
(Continued)

(58) Field of Classification Search
CPC . B65H 1/04; B65H 1/06; B65H 1/266; B65H 5/062; B65H 5/38; B65H 2404/611; B65H 2601/11; B65H 2601/12; B65H 2801/03; B65H 85/00; G03G 15/00; G03G 15/23; G03G 15/234; G03G 15/6508; G03G 21/00; G03G 21/1695
See application file for complete search history.

(56) References Cited

U.S. PATENT DOCUMENTS 8,055,181 B2 * 11/2011 Murayama ..... G03G 15/6505 399/401
2009/0060568 A1 * 3/2009 Ishikawa ..... G03G 15/234 399/111
(Continued)

FOREIGN PATENT DOCUMENTS

JP 11212307 A * 8/1999 ..... G03G 15/00
JP 2002-012336 A 1/2002
(Continued)

*Primary Examiner* — Nguyen Q. Ha
(74) *Attorney, Agent, or Firm* — Burr & Brown, PLLC

(57) ABSTRACT

An image forming apparatus having a duplex conveyer is provided. The duplex conveyer includes a first roller and a second roller arranged in an area closer to a first side surface of a body rather than a second side surface to align along a widthwise direction, a third roller and a fourth roller arranged to contact the first roller and the second roller respectively, an upper guide supporting the first roller and the second roller, and a lower guide arranged to face the upper guide at a position lower than the upper guide. The upper guide has a recessed portion at a position between the first roller and the second roller. The recessed portion recesses from an end of the upper guide on a side facing the first side surface toward the second side surface beyond an axis of the first roller.

8 Claims, 7 Drawing Sheets

(51) Int. Cl.

| | |
|---|---|
| ***B65H 85/00*** | (2006.01) |
| ***B65H 5/06*** | (2006.01) |
| ***G03G 21/16*** | (2006.01) |
| ***B65H 1/26*** | (2006.01) |
| ***B65H 3/06*** | (2006.01) |
| ***B65H 1/04*** | (2006.01) |
| ***B65H 5/38*** | (2006.01) |

(52) U.S. Cl.
CPC .... *B65H 2404/611* (2013.01); *B65H 2601/11* (2013.01); *B65H 2801/03* (2013.01); *B65H 2801/12* (2013.01)

(56) References Cited

U.S. PATENT DOCUMENTS

| | | | | |
|---|---|---|---|---|
| 2017/0137244 | A1* | 5/2017 | Maruta | B65H 1/266 |
| 2017/0320701 | A1* | 11/2017 | Hale | G03G 15/234 |

FOREIGN PATENT DOCUMENTS

| | | | | | |
|---|---|---|---|---|---|
| JP | 2002-137873 | A | | 5/2002 | |
| JP | 2003-255644 | A | | 9/2003 | |
| JP | 2008-222407 | A | | 9/2008 | |
| JP | 2014092571 | A | * | 5/2014 | B65H 7/20 |

* cited by examiner

IMAGE FORMING APPARATUS

CROSS REFERENCE TO RELATED APPLICATION

This application claims priority from Japanese Patent Application No. 2017-073304, filed on Mar. 31, 2017, the entire subject matter of which is incorporated herein by reference.

BACKGROUND

Technical Field

An aspect of the present disclosure is related to an image forming apparatus.

Related Art

An image forming apparatus capable of double-face printing, or duplex printing, i.e., forming images on both sides of a sheet, is known. The image forming apparatus may have a duplex conveyer at a lower position with respect to a feeder tray. When an image is to be formed solely on one side of a sheet, the sheet may be conveyed from the feeder tray to an image forming device, in which the image is formed on the sheet, and the sheet with the image formed thereon may be ejected outward at an ejection tray without being conveyed to the duplex conveyer. When images are to be formed on both sides of a sheet, the sheet may be conveyed from the feeder tray to the image forming device, in which an image may be formed on one side of the sheet, and the sheet with the image formed on the one side may be conveyed to the duplex conveyer. As the sheet is conveyed in the duplex conveyer, the sheet may be inverted, and the inverted sheet may be conveyed again to the image forming device with the other side facing toward the image forming device. The image forming device may form another image on the other side of the sheet, and the sheet may be thereafter ejected outward at the ejection tray.

While the sheet is conveyed in the duplex conveyer, the sheet may jam in a conveyer path in the duplex conveyer, and the jammed sheet may need to be removed. In order to remove the jammed sheet promptly or easily, for example, the duplex conveyer may have an upper guide and a lower guide, which are separable from each other, and a user may remove the feeder tray from a body of the image forming apparatus and uplift the upper guide so that the conveyer path between the upper guide and the lower guide may be expanded to be accessible to the user.

SUMMARY

Meanwhile, in the duplex conveyer, positions of parts attached to the upper guide that is movable, e.g., rollers, may not be maintained accurately, and sheet conveying quality of the duplex conveyer may be lowered. For example, an oblique conveyer roller, which may convey and shift the sheet sideward to one end of the conveyer path with regard to a widthwise direction (a direction orthogonal to a conveying direction), may be attached to the upper guide. While the upper guide is movable, a position or an angle of the oblique conveyer roller may not be maintained stably, and sheet conveying quality of the oblique roller may be affected undesirably.

The present disclosure is advantageous in that an image forming apparatus, in which a sheet conveying quality in a duplex conveyer may be restrained from lowering, and a procedure to remove a jammed sheet may be preferable, is provided.

According to an aspect of the present disclosure, an image forming apparatus, having a body, a feeder tray, a duplex conveyer, is provided. The body includes an image forming device to form an image on a sheet, a first side surface having an opening portion, and a second side surface on a side opposite of the first side surface. The feeder tray is configured to be detachably attached to the body through the opening portion and to support the sheet to be conveyed to the image forming device. The duplex conveyer is arranged at a position lower than the feeder tray in the body. The duplex conveyer is configured to convey the sheet with the image formed on one side thereof to return to the image forming device. The duplex conveyer includes a first roller and a second roller arranged in an area closer to the first side surface rather than the second side surface to align along a widthwise direction being orthogonal to a conveying direction to convey the sheet, a third roller and a fourth roller arranged to contact the first roller and the second roller, respectively, an upper guide supporting the first roller and the second roller, and a lower guide arranged to face the upper guide at a position lower than the upper guide. The upper guide has a recessed portion at a position between the first roller and the second roller. The recessed portion recesses from an end of the upper guide on a side facing the first side surface toward the second side surface beyond an axis of the first roller.

BRIEF DESCRIPTION OF THE ACCOMPANYING DRAWINGS

DETAILED DESCRIPTION

Hereinafter, an embodiment of the present disclosure will be described with reference to the accompanying drawings.

<Exterior Configuration of Printer>

Figure 1:
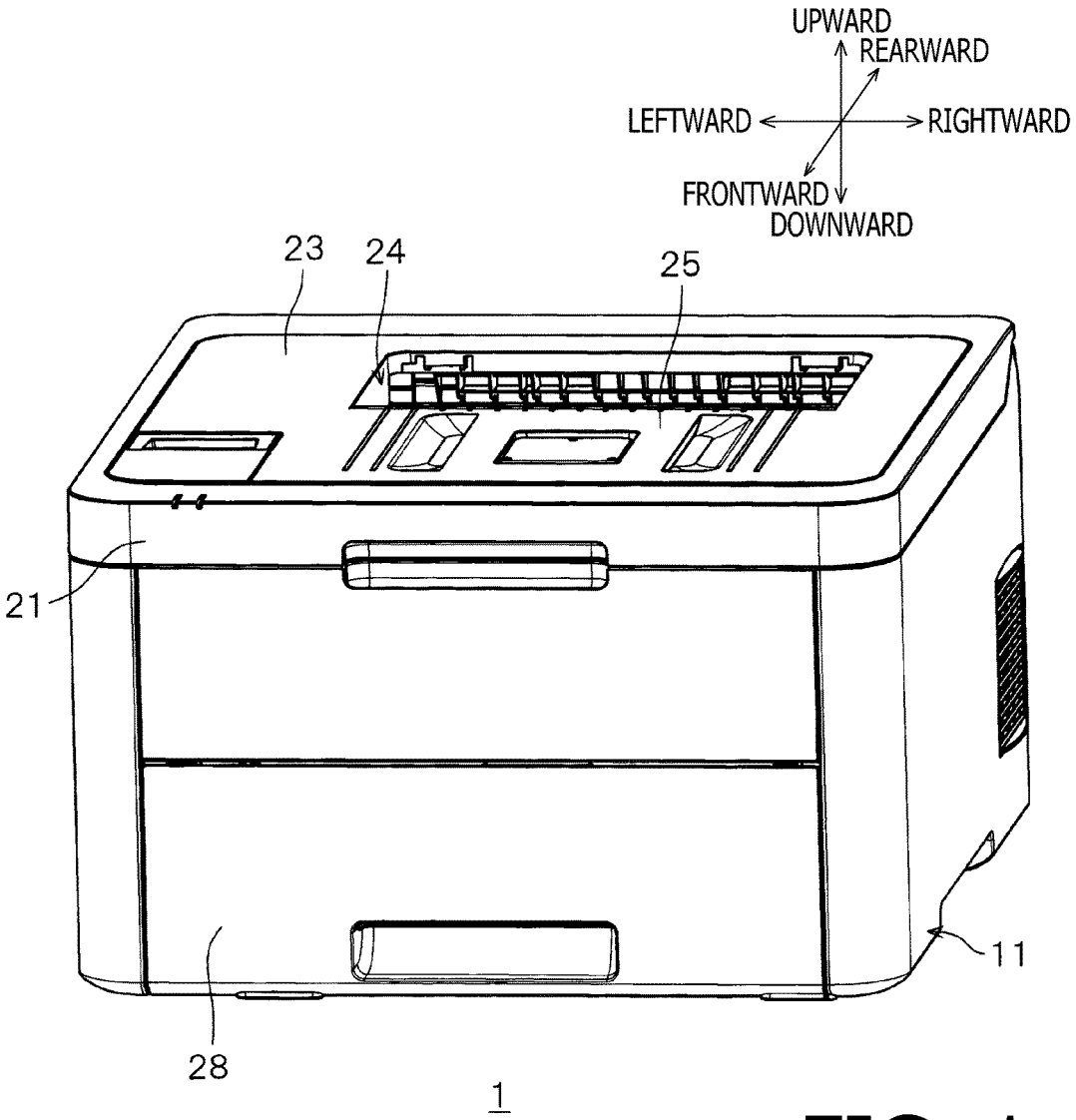
FIG. 1 is a perspective view of an image forming apparatus, with a feeder tray being attached to a body, according to an embodiment of the present disclosure.
Figure 2:
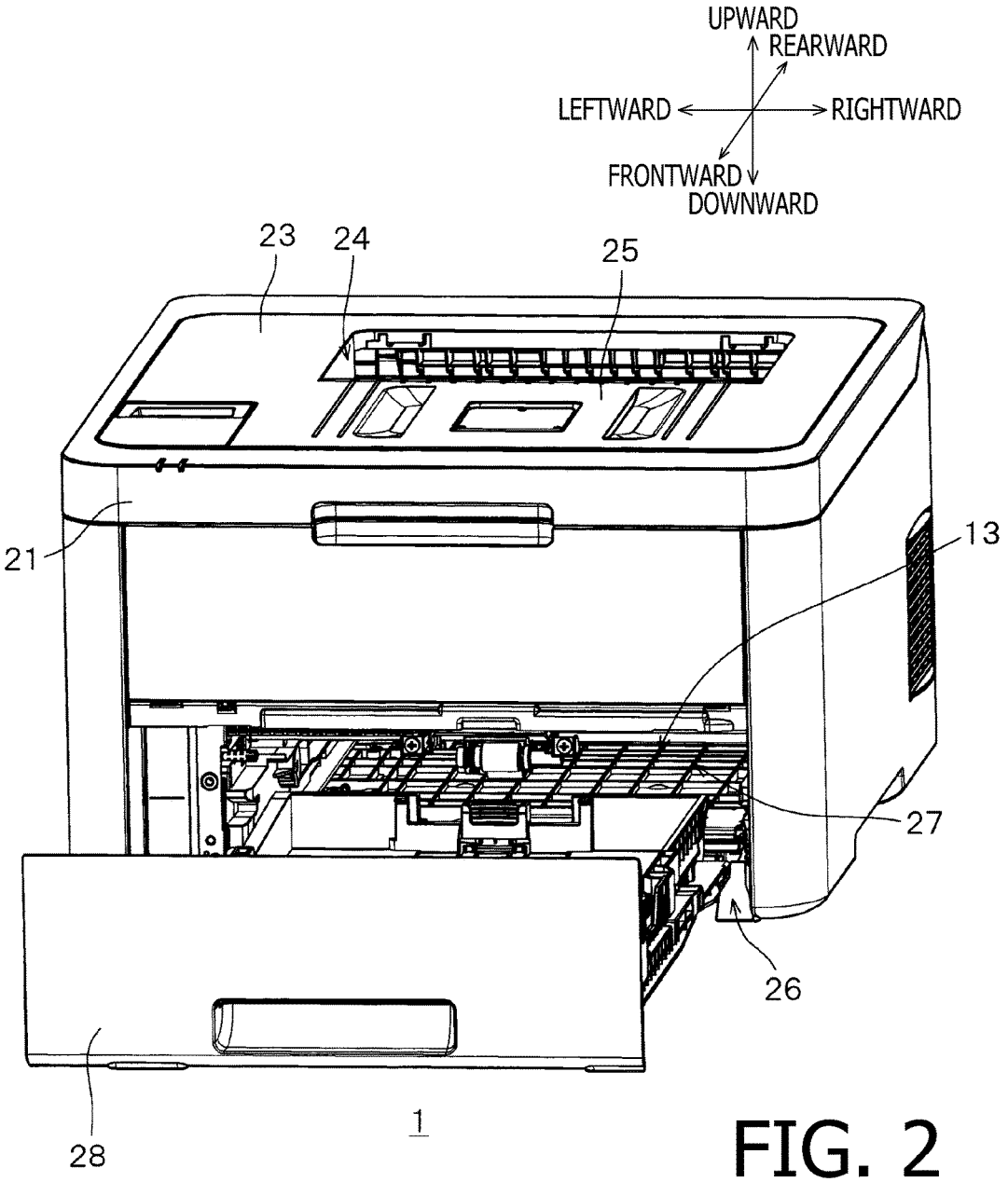
FIG. 2 is a perspective view of the image forming apparatus, with the feeder tray being drawn outside the body, according to the embodiment of the present disclosure.

A printer 1, as shown in FIGS. 1-2, includes a body 11, a feeder tray 12, and a duplex conveyer 13.

The body 11 has a first side surface 21 and a second side surface 22 (see FIG. 4), which face each other at spaced apart positions. When the printer 1 is placed on a horizontal plane, the first side surface 21 and the second side surface 22 may stand substantially vertically to the horizontal plane. The body 11 includes an upper surface 23, which spreads between upper ends of the first side surface 21 and the second side surface 22. The upper surface 23 includes a dent 24, which dents downward. An area inside the dent 24 and an area closer to the first side surface 21 on the upper surface 23 form an ejection tray 25.

In the following description, directions related the printer 1 and each part or item included in the printer 1 will be mentioned on basis of directions indicated by arrows in each drawing. For example, a side, on which the first side surface 21 is arranged, may be referred to a frontward side. A direction, along which the first side surface 21 and the second side surface 22 face each other, may be referred to as a front-rear direction. A user may face the first side surface 21 in order to ordinarily use the printer 1, and the user's right-hand side and left-hand side may be referred to a rightward side and a leftward side, respectively, and a left-to-right or right-to-left direction may be referred to as a widthwise direction. An up-to-down or down-to-up direction may be referred to as a vertical direction.

Figure 3:
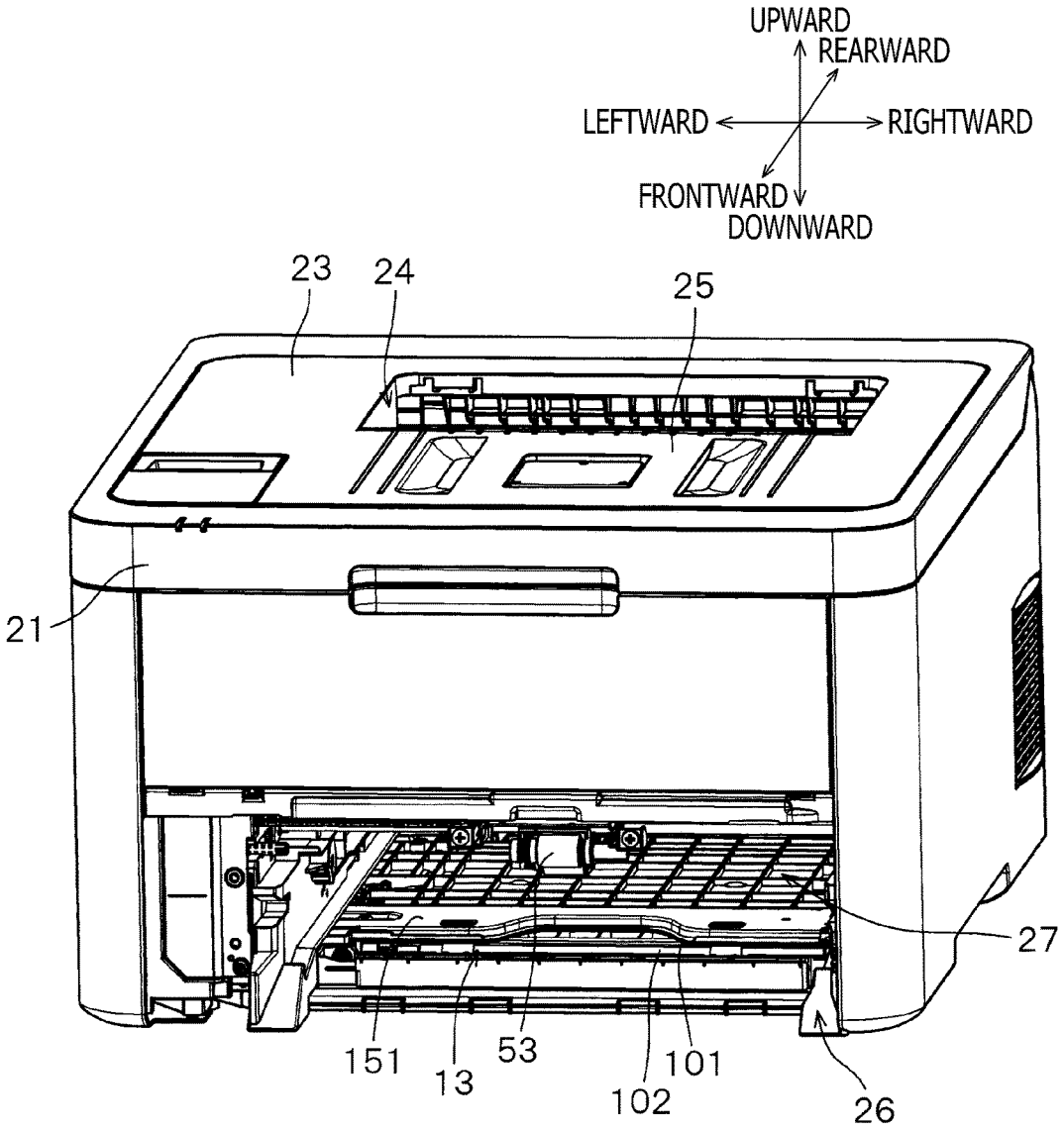
FIG. 3 is a perspective view of the body and a duplex conveyer in the image forming apparatus according to the embodiment of the present disclosure.

At a lower position on the first side surface 21, as shown in FIGS. 2-3, formed is an opening portion 26, through which the feeder tray 12 may be detachably attached to the body 11. Inside the body 11, a tray attachment section 27 extending rearward from the opening portion 26 is formed, and the feeder tray 12 is movable in the body 11 to be attached to the tray attachment section 27 (see FIG. 1) and to be drawn frontward from the tray attachment section 27 (see FIGS. 2-3). The feeder tray 12 includes a front surface 28, which may close the opening portion 26 at the frontward position and form a part of the first side surface 21 of the body 11 when the feeder tray 12 is attached to the tray attachment section 27 (see FIG. 1). The feeder tray 12 may support one or more sheets S (see FIG. 4) in a stack thereon.

The duplex conveyer 13 is, as shown in FIGS. 2-3, arranged at a lower position with respect to the tray attachment section 27 in the body 11. The duplex conveyer 13 may be exposed through the opening portion 26 when the feeder tray 12 is drawn frontward to be removed from the tray attachment section 27, as shown in FIG. 3.

<Interior Configuration of the Printer>

Figure 4:
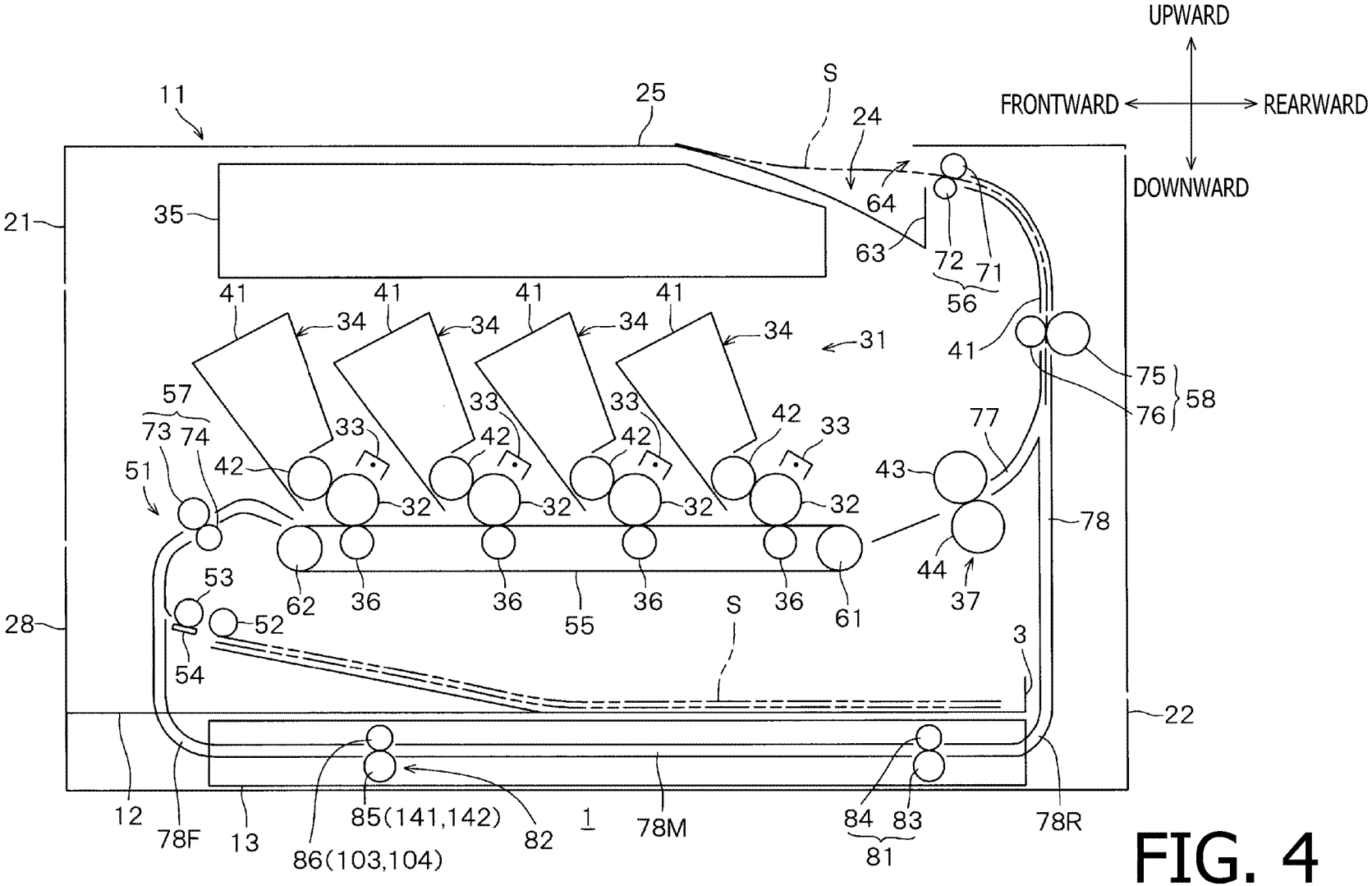
FIG. 4 is a cross-sectional view of the image forming apparatus according to the embodiment of the present disclosure.

The printer 1 may be, as shown in FIG. 4, but not necessarily be limited to, a color laser printer. Optionally, the printer 1 may be a monochrome laser printer or may be an inkjet printer to form an image on a sheet S in an inkjet-printing technic.

Inside the body 11, arranged is an image forming device 31, which may form an image on the sheet S in an electrophotographic technic. The image forming device 31 may include four (4) photosensitive drums 32, four (4) chargers 33, four (4) developer devices, an exposure device 35, four (4) transfer rollers 36, and a fuser 37.

The photosensitive drums 32 are for forming images in different colors, e.g., black (K), yellow (Y), magenta (M), and cyan (C) and may be arranged in this mentioned order from upstream to downstream along the front-rear direction to convey the sheet P at upper positions with respect to the feeder tray 12 to be spaced apart evenly from one another. The photosensitive drums 32 are rotatable about respective rotation axes, which extend in the widthwise direction.

The chargers 33 are respectively provided to corresponding one of the photosensitive drums 32, and each charger 33 is arranged at an upper-rearward position of the corresponding photosensitive drum 32. The chargers 33 may be, for example, scorotron chargers each having a wire and a grid.

The developer devices 34 are respectively provided to corresponding one of the photosensitive drums 32, and each developer device 34 is arranged at an upper-frontward position of the corresponding photosensitive drum 32. Each developer device 34 includes a developer housing 41 to contain toner and a developer roller 42 held by the developer housing 41. The developer roller 42 is rotatable about an axis, which extends in the widthwise direction. A circumferential surface of the developer roller 49 contacts a circumferential surface of the corresponding photosensitive drum 32.

The exposure device 35 is arranged at an upper position with respect to the chargers 33 and the developer devices 34. The exposure device 35 includes an optical system, including a laser emitter and polygon mirrors, to emit laser beams at the photosensitive drums 32 according to image data.

The transfer rollers 36 are each arranged at a lower position with respect to the corresponding one of the photosensitive drums 32. The transfer rollers 36 are rotatable about respective axes, which extend in the widthwise direction.

The fuser 37 is arranged at a rearward position with respect to the photosensitive drum 32 at the most rearward position. The fuser 37 includes a heating roller 43 and a pressing roller 44. The heating roller 43 is rotatable about an axis, which extends in the widthwise direction. The pressing roller 44 is arranged at a lower-rearward position with respect to the heating roller 43 and is rotatable about an axis, which extends in the widthwise direction. A circumferential surface of the pressing roller 44 contacts a circumferential surface of the heating roller 43.

Inside the body 11, further, arranged is a sheet conveyer 51 to convey the sheet S in a conveying direction, which may be in parallel with the front-rear direction and orthogonal to the widthwise direction. The sheet conveyer 51 includes a feeder roller 52, a separator roller 53, a separator pad 54, a conveyer belt 55, an ejection roller pair 56, a first conveyer roller pair 57, and a second conveyer roller pair 58.

The feeder roller 52 is arranged at an upper position with respect to a frontward end of the feeder tray 12. The feeder roller 52 is in an arrangement such that a circumferential surface of the feeder roller 52 may contact an upper surface of a topmost sheet S in the stack of sheets S supported on the feeder tray 12.

The separator roller 53 and the separator pad 54 are arranged at frontward positions with respect to the feeder roller 52. The separator roller 53 is rotatable about a rotation axis, which extends in the widthwise direction. The separator pad 54 may contact a circumferential surface of the separator roller 53 at a lower-frontward position with respect to the separator roller 53.

The conveyer belt 55 is arranged at a lower position with respect to the photosensitive drums 32. The conveyer belt 55 is an endless belt strained around rollers 61, 62. The rollers 61, 62 are arranged at a same height and spaced apart in the front-rear direction from each other. The conveyer belt 55 has flat areas, which overlap each other vertically and spread in the front-rear direction and the widthwise direction, in a range between the rollers 61, 62. An upper one of the flat areas of the conveyer belt 55 extends between the photosensitive drums 32 and the transfer rollers 36 and contacts circumferential surfaces of the photosensitive drums 32 on one side and circumferential surfaces of the transfer roller 36 on the other side.

The body 11 includes a wall surface 63, which stands upward at a rearward end of the dent 24 formed on the upper surface 23. In the wall surface 63, formed is a sheet outlet 64, through which the sheet S may be ejected at the ejection tray 25. The ejection roller pair 56 is arranged at a rearward position with respect to the sheet outlet 64. The ejection roller pair 56 includes a pair of rollers, which are a driving roller 71 and a driven rollers 72. The driving roller 71 and the driven roller 72 are arranged to contact each other at circumferential surfaces and are rotatable about respective rotation axes thereof, which extend in the widthwise direction. A contact area between the circumferential surfaces of the driving roller 71 and the driven roller 72 is located at a rearward position with respect to the sheet outlet 64.

The first conveyer roller pair 57 is arranged at an upper position with respect to the separator roller 53 and a frontward position with respect to the conveyer belt 55. The first conveyer roller pair 53 includes a pair of rollers, which are a driving roller 73 and a driven roller 74. The driving roller 73 and the driven roller 74 are arranged to contact each other at circumferential surfaces and are rotatable about respective axes thereof, which extend in the widthwise direction.

The second conveyer roller pair 58 is arranged at an upper-rearward position with respect to the fuser 37. The second conveyer roller pair 58 includes a pair of rollers, which are a driving roller 75 and a driven roller 76. The driving roller 75 and the driven roller 76 are arranged to contact each other at circumferential surfaces thereof and are rotatable about respective axes thereof, which extend in the widthwise direction.

In order to print an image on a sheet S, the sheet conveyer 51 may operate to convey the sheet S, and the image forming device 31 may form an image on the sheet S being conveyed.

In order to convey the sheet S from the feeder tray 12, the feeder roller 52 may rotate clockwise in a view from the right (see FIG. 1). As the feeder roller 52 rotates, the sheet S being in contact with the circumferential surface of the feeder roller 52, i.e., a topmost sheet S in the stack of sheets S supported on the feeder tray 12, is conveyed frontward. The sheet S from the feeder tray 12 is forwarded through the position between the separator roller 53 and the separator pad 53 to be separated from other sheets S in the stack.

The sheet S traveling through the position between the separator roller 53 and the separator pad 54 is conveyed to a position on the conveyer belt 55, which may circulate clockwise in the view from the right. The sheet S conveyed to the conveyer belt 55 moves along with the upper flat area in the conveyer belt 55 to pass through the positions between the photosensitive drums 32 and the conveyer belt 55.

The photosensitive drums 32 may rotate counterclockwise in the view from the right. As the photosensitive drums 32 rotate, the surfaces of the photosensitive drums 32 are charged evenly by the chargers 33 and selectively exposed to the laser beams from the exposure device 35. Potential in areas on the surfaces of the photosensitive drums 32 exposed to the laser beams is lowered to form electrostatic latent images on the surfaces of the photosensitive drums 32. Thereafter, positively charged toner is supplied by the developer rollers 42 to the electrostatic latent images on the surfaces of the photosensitive drums 32 so that the electrostatic images are developed to be toner images and carried on the surfaces of the photosensitive drums 32.

Meanwhile, transfer bias is applied to the transfer rollers 36. In order to form a monochrome image on the sheet S, a toner image is formed on a surface of the photosensitive drum 32 corresponding to the developer device 34 containing black toner. As the sheet S proceeds through the position between the photosensitive drum 32 and the transfer roller 36, the toner image in black may be transferred from the surface of the photosensitive drum 32 to an upper side of the sheet S due to an effect of the transfer bias. In order to form a colored image, toner images formed on the surfaces of the photosensitive drums 32 corresponding to the developer devices 34 containing black, yellow, cyan, and magenta toners are transferred in layers onto the upper side of the sheet S due to the effect of the transfer bias.

The sheet S with the toner images transferred thereon may proceed further rearward to enter the fuser 37. In the fuser 37, the sheet S proceeds through the position between the heating roller 43 and the pressing roller 44 while the toner images are fixed onto the sheet S. With the heat and the pressure applied thereto, forming the image on a first side of the sheet S may be completed.

The printer 1 may perform single-face printing, in which an image may be formed solely on the first side of the sheet S, and duplex printing, in which images may be formed on both the first side and a second side of the sheet S.

In a single-face printing operation, the sheet S with the image formed on the first side is conveyed by the second conveyer roller pair 58 and the ejection roller pair 56 to be ejected outside the body 11 through the sheet outlet 64 to rest on the ejection tray 25. Thus, the sheet S conveyed from the feeder tray 12 may travel in the conveyer path 77 through the position between the separator roller 53 and the separator pad 54, the positions between the photosensitive drums 32 and the conveyer belt 55, the position between the heating roller 43 and the pressing roller 44 in the fuser 37, the position between the driving roller 75 and the driven roller 76 in the second conveyer roller pair 58, and the position between the driving roller 71 and the driven roller 75 in the ejection roller pair 56, sequentially, to the ejection tray 25.

In order to enable a duplex printing operation, the printer 1 has an inverting conveyer path 78. The inverting conveyer path 78 branches off from the conveyer path 77 at a position between the second conveyer roller pair 58 and the ejection roller pair 56, extends downward at a rearward area in the body 11, curves frontward at a position rearward with respect to the duplex conveyer 13, which is arranged at a position lower than the feeder tray 12, to extend frontward in the duplex conveyer 13, curves upward at a position frontward with respect to the duplex conveyer 13, and merges with the conveyer path 77 at a position between the separator roller 53 and the first conveyer roller pair 57.

The duplex conveyer 13 includes a section 78M, which extends in the front-rear direction, in the inverting conveyer path 78. The inverting conveyer path 78 includes a curved section 78F, which extends frontward and curves upward at a position frontward with respect to the duplex conveyer 13, and a curved section 78R, which extends downward and curves frontward at a position rearward with respect to the duplex conveyer 13. In the duplex conveyer 13, arranged are a first inverting conveyer roller pair 81 and a second inverting conveyer roller pair 82.

The first inverting roller pair 81 includes a pair of roller, which are a driving roller 83 and a driven roller 84. The driving roller 83 and the driven roller 84 are arranged to contact each other at circumferential surfaces and are rotatable about respective axes thereof, which extend in the widthwise direction.

The second inverting conveyer roller pair 82, arranged frontward with respect to the first inverting roller pair 81, includes a pair of rollers, which are a driving roller 85 and a driven roller 86. The driving roller 85 and the driven roller 86 are arranged to contact each other at circumferential surfaces to nip the sheet S there-between and are rotatable about respective axes thereof, which extend in the widthwise direction.

In a duplex printing operation, the sheet S with the image formed on the first side is conveyed by the ejection roller pair 56 in a reverse direction to be directed to the inverting conveyer path 78 without being ejected at the ejection tray 25. The sheet S directed to the inverting conveyer path 78 may be conveyed in the inverting conveyer path 78 frontward by the first inverting conveyer roller pair 81 and the second inverting conveyer roller pair 82 to the conveyer path 77. The sheet S conveyed through the inverting conveyer path 78 is inverted upside down so that the sheet S may be conveyed in the conveyer path 77 with the second side, on which no image is yet formed, facing toward the photosensitive drums 32. The inverted sheet S proceeds in the conveyer path 77 toward the photosensitive drums 32 so that another image may be formed on the second side of the sheet S, in the same manner as the image was formed on the first side of the sheet S. The sheet S with the images formed on the first and second sides is conveyed by the second conveyer roller pair 58 and the ejection roller pair 56 and ejected through the sheet outlet 64 to be released in the ejection tray 25.

<Duplex Conveyer>

Figure 5:
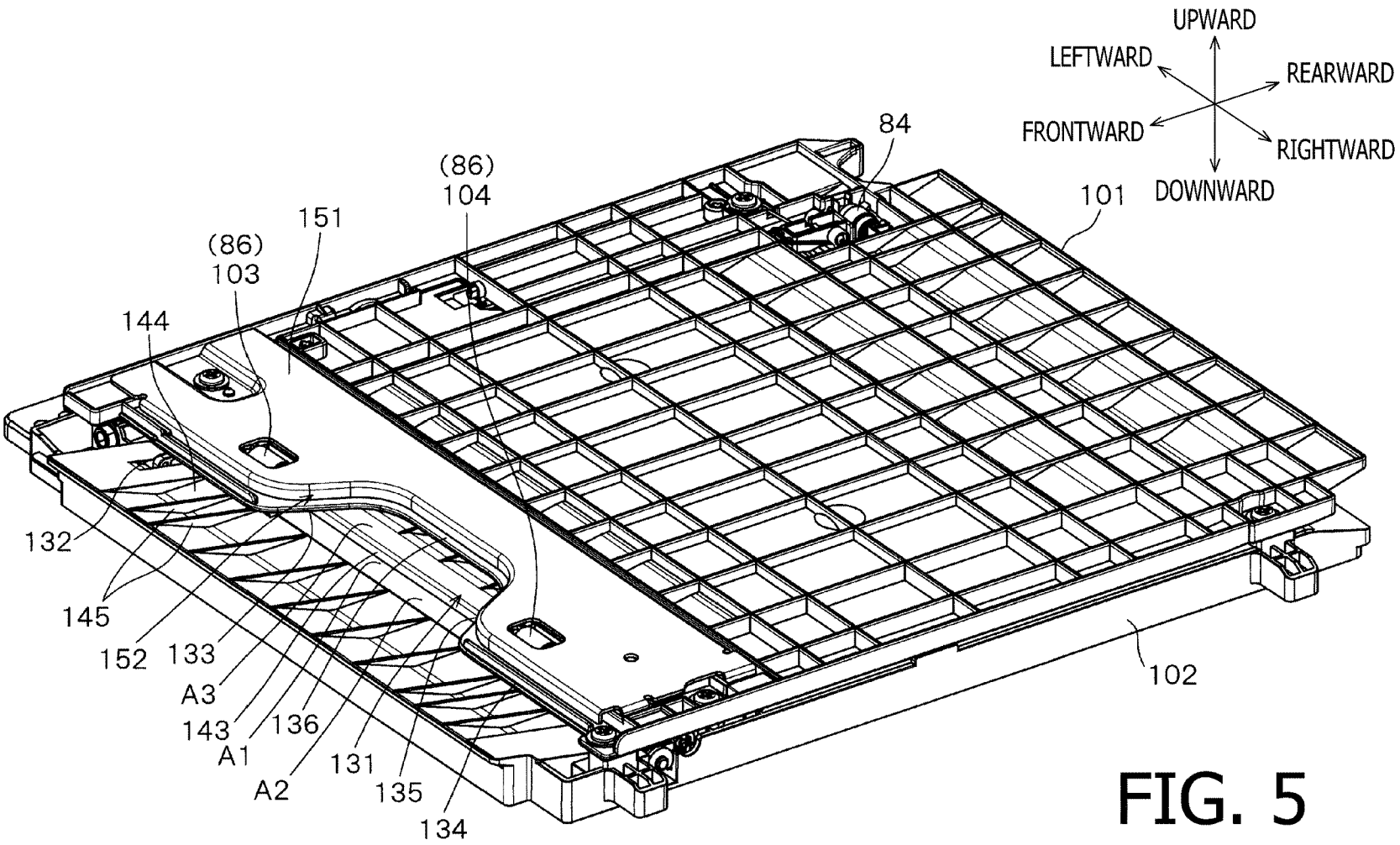
FIG. 5 is a perspective view of the duplex conveyer for the image forming apparatus according to the embodiment of the present disclosure.
Figure 6:
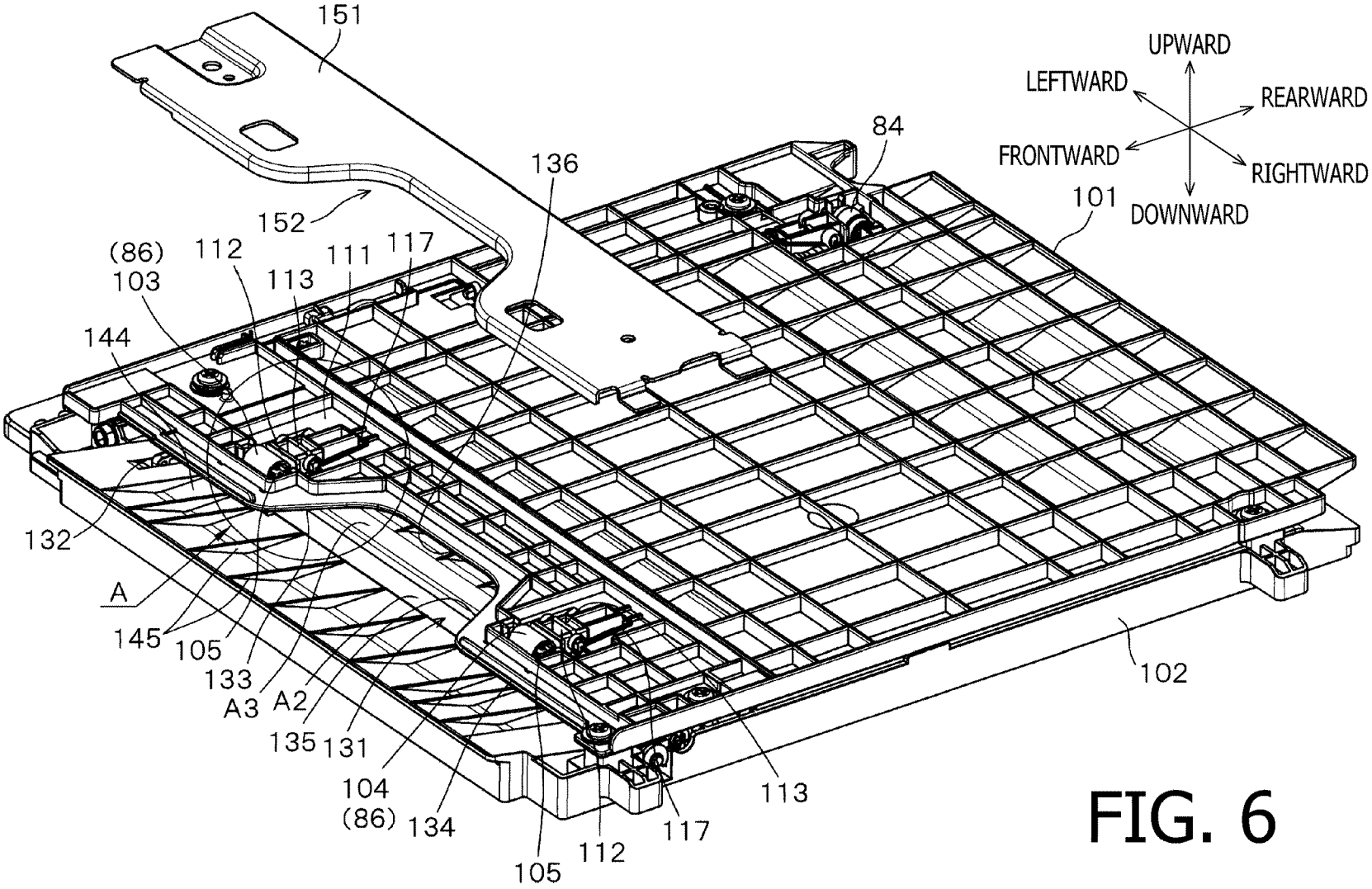
FIG. 6 is an exploded view of the duplex conveyer for the image forming apparatus, with an enhancing member being detached, according to the embodiment of the present disclosure.

The duplex conveyer 13 includes, as shown in FIGS. 5-6, an upper guide 101 and a lower guide 102.

<Upper Guide>

The upper guide 101 is made of resin and formed in an approximate shape of a rectangular plate, which spreads in the front-rear direction and the widthwise direction. The upper guide 101 rotatably supports the driven roller 84 in the first inverting conveyer roller pair 81 and the driven roller 86 in the second inverting conveyer roller pair 82.

The driven roller 84 is arranged at a rear-leftward position in the upper guide 101. The driven roller 84 may be, for example, attached around a circumferential surface of a resin-made shaft or may be formed integrally with a shaft. The shaft of the driven roller 84 is arranged to incline with respect to the front-rear direction to be closer to the front at the rightward side and farther from the front at the leftward side. Due to this oblique arrangement, the driven roller 84 may apply an oblique conveying force, which may act in a frontward direction being downstream along the conveying direction and a leftward direction, to the sheet S. In other words, the driven roller 84 is an oblique conveyer roller, which may shift and convey the sheet leftward and frontward.

The driven roller 86 in the second inverting conveyer roller pair 82 includes a first driven roller 103 and a second driven roller 104. The first driven roller 103 and the second driven roller 104 are arranged to be spaced apart from each other aligning along the widthwise direction at a front-end area, which is an area closer to the first side surface 21 rather than the second side surface 22, in the upper guide 101. The first driven roller 103 and the second driven roller 104 are rotatable about a common rotation axis, which extends in the widthwise direction.

The first driven roller 103 and the second driven roller 104 are in a same structure, except the widthwise positions thereof; therefore, in the following description, when the first driven roller 103 and the second driven roller 104 should not necessarily be distinguished, the term driven roller 86 may represent the first driven roller 103 and the second driven roller 104.

Figure 7:
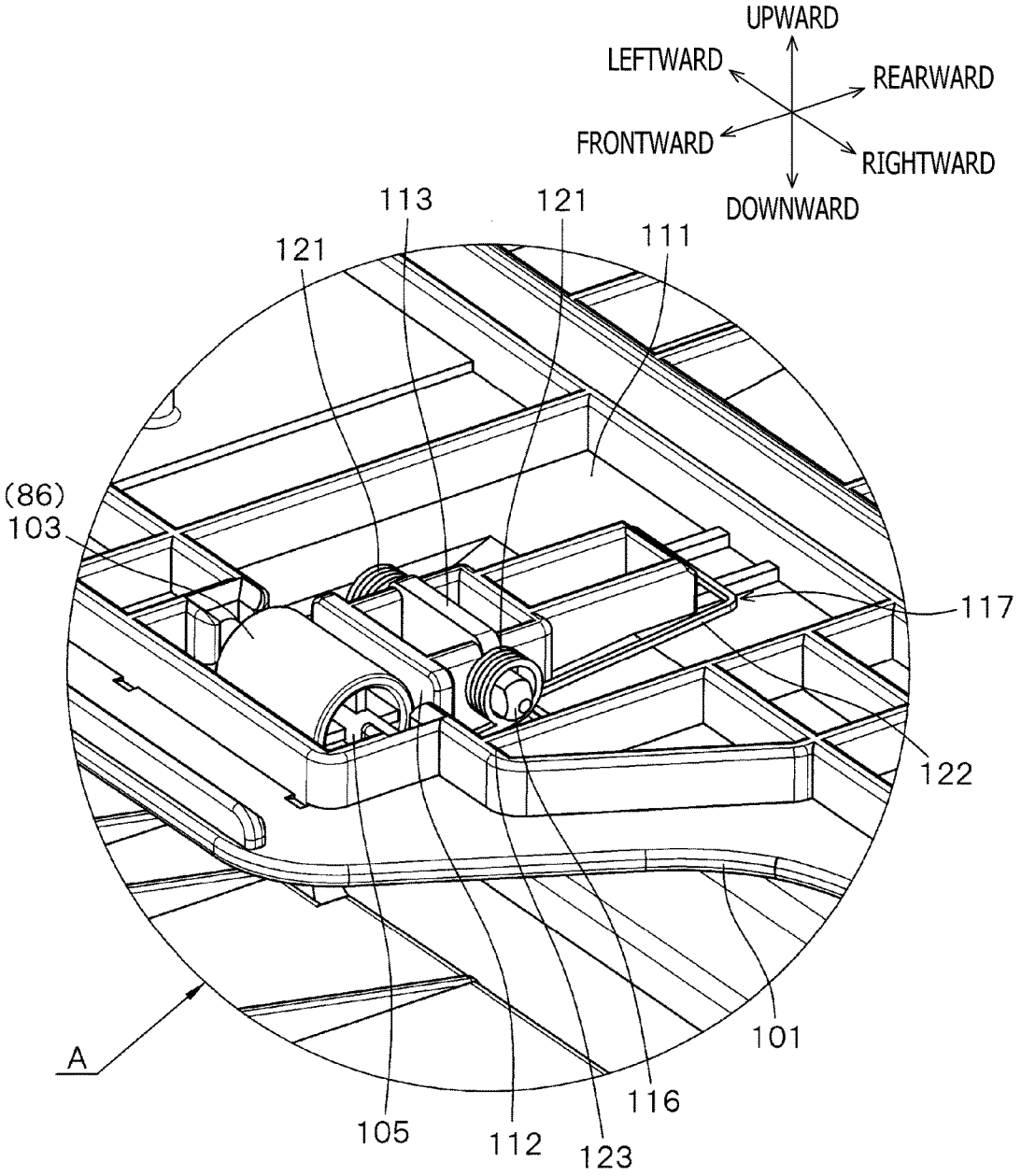
FIG. 7 is an enlarged view of an encircled area A shown in FIG. 6 in the duplex conveyer according to the embodiment of the present disclosure.

The driven roller 86 may be, as shown in FIG. 7, attached on a circumferential surface of a resin-made shaft 105 or may be formed integrally with a resin-made shaft 105. Axial ends of the shaft 105 protrude outward from sideward ends of the driven roller 86 and are supported rotatably by the upper guide 101. A circumferential surface of the driven roller 86 partly protrudes downward from a lower surface of the upper guide 101.

At a rearward position with respect to each of the first driven roller 103 and the second driven roller 104, arranged is a partition wall 112. The partition wall 112 is formed integrally with an upper surface 111 of the upper guide 101 in a shape of a plate extending upward from the upper surface 111 of the upper guide 101 and spreading in the widthwise direction.

At a rearward spaced-apart position with respect to the partition wall 112, arranged is a contact portion 113. The contact portion 113 is formed integrally with the upper surface 111 of the upper guide 101 in a shape of a plate extending upward from the upper surface 111 of the upper guide 101 and spreading in the widthwise direction. An upper end of the contact portion 113 is located to be higher than an upper end of the partition wall 112.

At rightward and leftward sides of the contact portion 113, arranged are spring holders 116. The spring holders 116 on the right and the left are formed integrally with the contact portion 113 and protrude rightward and leftward, respectively, from the contact portion 113.

FIGS. 6-7 shows merely the spring holder 116 on the right while the spring holder 116 on the left is omitted. The spring holder 116 on the left is in a similar but symmetrically reversed structure with respect to the spring holder 116 on the right.

The spring holders 116 hold a torsion coil spring 117. The torsion coil spring 117 may be a piece of wire coiled and bended. The torsion coil spring 117 includes two (2) coiled portions 122, which are coiled around the spring holders 116 on the right and the left respectively, a connecting portion 122 to connect between the coiled portions 122, and end portions 123, which each extends from the coiled portions 122 on the right and the left, respectively. The end portions 123 are arranged to contact the shaft 105 of the driven roller 86 at an upper position. Therefore, the driven roller 86 are urged downward by resilient force of the torsion coil spring 117.

The upper guide 101 includes, as shown in FIG. 6, a recessed portion 131 at a position between the first driven roller 103 and the second driven roller 104. The recessed portion 131 is recessed rearward from a frontward end of the upper guide 101 to a position beyond the common rotation axis of the first driven roller 103 and the second driven roller 104. The recessed portion 131 is formed in a shape to be open wider at the front and recede narrower at the rear. The frontward end of the upper guide 101 has a first linear portion 132, a second linear portion 133, a third linear portion 134, a fourth linear portion 135, and a fifth linear portion 136 in the recessed portion 131. The first linear portion 132 extends rightward from a leftward end of the upper guide 101 crossing over the position of the first driven roller 103. The second linear portion 133 extends from a rightward end of the first linear portion 132 rear-rightward to incline with respect to the widthwise direction. The third linear portion 134 extends leftward from a rightward end of the upper guide 101 crossing over the position of the second driven roller 104. The fourth linear portion 135 extends from a leftward end of the third linear portion 134 rear-leftward to incline with respect to the widthwise direction. The fifth linear portion 136 extends in the widthwise direction between a rearward end of the second linear portion 133 and a rearward end of the fourth linear portion 135.

<Lower Guide>

The lower guide 102 is made of resin and formed in an approximate shape of a rectangular plate, which spreads in the front-rear direction and the widthwise direction. A dimension of the lower guide 102 in the widthwise direction is equal to a dimension of the upper guide 101 in the widthwise direction. A dimension of the lower guide 102 in the front-rear direction is larger than a dimension of the upper guide 101 in the front-rear direction. A rearward edge of the lower guide 102 vertically overlaps a rearward edge of the upper guide 101 while a frontward edge of the lower guide 102 is located frontward with respect to the frontward edge of the upper guide 101.

The lower guide 102 rotatably supports the driving roller 83 in the first inverting conveyer roller pair 81 and the driving roller 85 in the second inverting conveyer roller pair 82.

The driving roller 83 is a rubber roller in a cylindrical shape attached around a circumference of a resin-made shaft. As shown in FIG. 4, the driving roller 83 is arranged at a lower position with respect to the driven roller 84 in the first inverting conveyer roller pair 81. A circumferential surface of the driving roller 83 contacts a lower part of a circumferential surface of the driven roller 84.

While the driven roller 86 in the second inverting conveyer roller pair 82 includes two (2) rollers, which are the first driven roller 103 and the second driven roller 104, the driving roller 85 in the second inverting conveyer roller pair 82 includes two (2) rollers as well, which are a first driving roller 141 and a second driving roller 142. The first driving roller 141 and the second driving roller 142 are rubber rollers in a cylindrical shape attached around a circumference of a common driving shaft 143 to rotate along with the driving shaft 143. The first driving roller 141 and the second driving roller 142 are arranged at lower positions with respect to the first driven roller 103 and the second driven roller 104, respectively. Therefore, as shown in FIGS. 5-6, the driving shaft 143 extends in the widthwise direction at a vertically lower position with respect to the shaft 105 of the driven roller 86 at a same position in the front-rear direction as the shaft 105 of the driven roller 86 and is exposed upward through the recessed portion 131 in the upper guide 101.

On an upper surface 144 of the lower guide 102, formed are a plurality of ribs 145. The ribs 145 are spaced apart along the widthwise direction from one another. The ribs 145 protrude upward from the upper surface 144 and longitudinally extend in the front-rear direction. Upper edges of the ribs 145 align on a same plane to support the sheet S being conveyed in the inverting conveyer path 78 from below.

Meanwhile, on the upper surface 144 of the lower guide 102, in a facing area A1, which faces and overlaps the driving shaft 143 vertically, a frontward area A2, which is a frontward area with respect to the facing area A1, and a rearward area A3, which is a rearward area with respect to the facing area A1, no rib 145 is formed. In other words, the ribs 145 are formed on the upper surface 144 of the lower guide 102 except in the facing area A1 facing the driving shaft 143 vertically, the frontward area A2 being a frontward area with respect to the facing area A1, and the rearward area A3 being a rearward area with respect to the facing area A1. The upper surface 144 of the lower guide 102 has plane surfaces in the facing area A1, the frontward area A2, and the rearward area A3.

<Enhancing Member>

The duplex conveyer 13 has, as shown in FIGS. 5-6, an enhancing member 151.

The enhancing member 151 is a metal plate having a substantially same width as the widthwise dimension of the upper guide 101. The enhancing member 151 is arranged over a frontward portion of the upper guide 101 to cover an area, in which the driven roller 86 and the torsion coil spring 117 are arranged, from above and fastened to the upper guide 101 by bolts (unsigned). While the enhancing member 151 is placed to cover an upper surface of the upper guide 101, the contact portions 113 in the upper guide 101 contact a lower surface of the enhancing member 151.

The enhancing member 151 has a recessed portion 152 at a widthwise central area in a frontend portion at a position corresponding to the recessed portion 131 in the upper guide 101. The recessed portion 152 is formed in a shape to be open wider at the front and recede narrower at the rear end. Edges of the recessed portion 152 are located outward with respect to the edges of the recessed portion 131 in the upper guide 101, i.e., the second linear portion 133, the fourth linear portion 135, and the fifth linear portion 136.

<Benefits>

As described above, the feeder tray 12 to support the sheets S may be detachably attached to the body 11 through the opening portion 26 arranged in the body 11. At the lower position with respect to the feeder tray 12, arranged is the duplex conveyer 13 to convey the sheet S when an image is to be formed on the second side of the sheet S. The duplex conveyer 13 has the upper guide 101, which supports the first driven roller 103 and the second driven roller 104, and the lower guide 102, which supports the first driving roller 141 and the second driving roller 142.

The upper guide 101 has the recessed portion 131 at the position between the first driven roller 103 and the second driven roller 104. The recessed portion 131 dents rearward from the edge of the upper guide 101 on the side of the opening portion 26 toward the other side opposite of the opening portion 26 across the common rotation axis of the first driven roller 103 and the second driven roller 104. When the feeder tray 12 is detached from the body 11, the first driven roller 103 and the second driven roller 104 may be exposed through the opening portion 26. Therefore, in a case where the sheet S jams in the duplex conveyer 13, the feeder tray 12 may be detached from the body 11 so that a user may reach the sheet S through the opening portion 26 and through the recessed portion 131 and remove the sheet S. In this action, the upper guide 101 needs not to be moved.

Thus, while the sheet-conveying quality of the duplex conveyer 13 may be restrained from lowering, a preferable procedure to clear the sheet jam may be offered.

The lower guide 102 has the plane surfaces in the area vertically coincident with the recessed portion 131, i.e., the facing area A1 that faces the common driving shaft 143 for the first driving roller 141 and the second driving roller 142 vertically, the frontward area A2 with respect to the facing area A1, and the rearward area A4 with respect to the facing area A1. Therefore, the user may press the sheet S against the plane surfaces with one hand and pull the sheet S with the other hand so that the sheet S may be removed easily to clear the sheet jam.

The driving shaft 143 is exposed upward through the recessed portion 131. Therefore, in order to remove the jammed sheet S, the user may manually rotate the driving shaft 143 to rotate the first driving roller 141 and the second driving roller 142 so that the jammed sheet S may be moved frontward. Thus, the sheet jam may be cleared even more easily.

The recessed portion 131 is formed in the shape to be open wider at the front and recede narrower at the rear. Therefore, a work area to handle the sheet jam may be wider toward the user, and the user may clear the sheet jam more easily.

The duplex conveyer 13 has the enhancing member 151 that covers the upper guide 101 from above. Meanwhile, the upper guide 101 has the contact portions 113, which protrude upward from the upper surface 111, to contact the enhancing member 151 when the enhancing member 151 is at the position to cover the upper guide 101.

The upper guide 101 holds the torsion coil spring 117, which urges the driven roller 86 downward. Therefore, a reaction force acting upward may be applied from the torsion coil spring 117 to the upper guide 101. While the contact portions 113 contact the enhancing member 151 from the lower side, the upper guide 101 may be restrained from creeping or deformation due to the reaction force from the torsion coil spring 117. Therefore, the position of the driven roller 86 may be maintained steadily, and the sheet S may be conveyed in the duplex conveyer 13 correctly.

At a position downstream from the duplex conveyer 13 along the conveying direction, the inverting conveyer path 78 has the curved section 78F to convey the sheet S toward the image forming device 31. When the sheet S is conveyed in a curved conveyer path, an intensity of conveying resistance against the sheet S may be unequal within the widthwise direction, and the sheet S may skew in the conveyer path. In this regard, with the first driven roller 103 and the second driven roller 104 arranged to be spaced apart from each other on one side and the other side with respect to a widthwise center in the duplex conveyer 13, the conveying force may be applied to the sheet S evenly within the widthwise direction. Therefore, the sheet S may be conveyed correctly through the curved section 78F.

Although an example of carrying out the invention have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An image forming apparatus, comprising:

a body including:

an image forming device configured to form an image on a sheet;

a first side surface having an opening portion; and a second side surface on a side opposite of the first side surface;

a feeder tray configured to be detachably attached to the body through the opening portion, the feeder tray being configured to support the sheet to be conveyed to the image forming device; and a duplex conveyer arranged at a position lower than the feeder tray in the body, the duplex conveyer being configured to convey the sheet with the image formed on one side thereof to return to the image forming device, the duplex conveyer comprising:

a first roller and a second roller arranged in an area closer to the first side surface rather than the second side surface, the first roller and the second roller aligning along a widthwise direction being orthogonal to a conveying direction to convey the sheet;

a third roller and a fourth roller arranged to contact the first roller and the second roller, respectively;

an upper guide supporting the first roller and the second roller; and a lower guide arranged to face the upper guide at a position lower than the upper guide, wherein the upper guide comprises a recessed portion at a position between the first roller and the second roller, the recessed portion recessing from an end of the upper guide on a side facing the first side surface toward the second side surface beyond an axis of the first roller.

2. The image forming apparatus according to claim 1, wherein the lower guide comprises a plane surface in an area vertically coincident with the recessed portion.

3. The image forming apparatus according to claim 2, wherein the third roller and the fourth roller are driving rollers having a common driving shaft; and wherein the plane surface is formed in a first area at a position closer to the first side surface with respect to the driving shaft and in a second area at a position closer to the second side surface with respect to the driving shaft.

4. The image forming apparatus according to claim 1, wherein the duplex conveyer comprises an enhancing member, the enhancing member being a metal plate arranged to cover the upper guide from above;

wherein the upper guide is made of resin; and wherein the upper guide comprises a contact portion extending upward toward the enhancing member to contact the enhancing member from below.

5. The image forming apparatus according to claim 1, wherein the third roller and the fourth roller are driving rollers having a common driving shaft; and wherein the driving shaft is arranged at a position to be exposed upward through the recessed portion.

6. The image forming apparatus according to claim 1, wherein the recessed portion is in a shape to be open wider at the side of the first side surface and narrower at an end on the side of the second side surface.

7. The image forming apparatus according to claim 1, wherein the duplex conveyer comprises an oblique conveyer roller configured to shift the sheet toward one side in the widthwise direction and convey the sheet downstream in the conveying direction.

8. The image forming apparatus according to claim 1, wherein the first roller and the second roller are arranged to be spaced apart from each other on one side and the other side with respect to a widthwise center in the duplex conveyer; and wherein the image forming apparatus comprises a curved conveyer path continuous to the image forming device at a position downstream from the duplex conveyer along the conveying direction.

* * * * *